United States Patent [19]

Rodermund et al.

[11] 4,287,647

[45] Sep. 8, 1981

[54] PROCESS AND APPARATUS FOR MAKING POMPONS

[76] Inventors: Gerd Rodermund, D-7631 Mahlberg; Helmut Kappus, Altfelixstrasse 26, D-7630 Lahr, both of Fed. Rep. of Germany

[21] Appl. No.: 107,561

[22] Filed: Dec. 27, 1979

[30] Foreign Application Priority Data

Oct. 20, 1979 [DE] Fed. Rep. of Germany ..... 2942492

[51] Int. Cl.[3] ..... D04D 7/06

[52] U.S. Cl. ..... 28/147; 57/24

[58] Field of Search ..... 57/3, 24; 28/147

[56] References Cited

U.S. PATENT DOCUMENTS

| | | | |
|---|---|---|---|
| 1,430,737 | 10/1922 | Harwood | 28/147 X |
| 1,436,898 | 11/1922 | Ohashi | 57/24 |
| 2,062,183 | 11/1936 | Lawson et al. | 28/147 |
| 3,330,103 | 7/1967 | Rodermund et al. | 57/24 |
| 3,780,514 | 12/1973 | Rodermund et al. | 57/24 X |
| 4,044,438 | 8/1977 | Everhart | 28/147 |

*Primary Examiner*—Donald Watkins

*Attorney, Agent, or Firm*—Finnegan, Henderson, Farabow, Garett & Dunner

[57] ABSTRACT

An apparatus and method for automatically forming pompons from a continuous strip of fringed web includes a pair of clamping jaws for gripping and advancing the web to a coiling station, a separable coiling spindle, and a binding tongs mechanism. When the web is moved to the coiling station, the coiling spindles are inserted into an aperture in the clamping jaws and clamp the end of the web. Thereafter, the clamping jaws are released and moved back to their initial position while the coiling spindle is rotated to coil a predetermined length of the fringed web. The binding tongs are then moved over the coiled section and draw a binding wire tightly about the periphery of the coil after the web is severed to separate the coil therefrom. The binding tongs are closed to clamp the binding wire and then are rotated to secure the wire about the coiled web. Closing of the tongs cuts the wire. A pair of compression members having rotationally symmetrical, concave faces are closed about the coiled strip to compression-shape the needles or fringed members of the web into an approximately spherical pompon shape.

16 Claims, 6 Drawing Figures

PROCESS AND APPARATUS FOR MAKING POMPONS

BACKGROUND OF THE INVENTION

Pompons, that is, spherical adorning structures of filaments or fibers directed approximately radially from the center of the sphere and most often provided with a stem, as a rule are made by hand. For instance the starting point is a garland in which needles cut from foils are fastened between twisted binding wires. Short segments of the binding wires and hence the garland then are bent into a ring using pliers, and thus the pompon is created. It is furthermore known already (U.S. Pat. No. 3,780,514), to manufacture pompons using a garland machine in which the strips of foil are split up or fringed between a pair of rollers and then are bound between twisting wires which are moved by a driven carriage. Pompons with stems are obtained by intermittent application of the foil strips, but these pompons do not meet all the requirements of external aesthetics.

OBJECTS AND SUMMARY OF THE INVENTION

It is thus an object of the invention to provide a process and apparatus for the fully automatic manufacture of pompons of the same or higher quality than is the case for those made by hand.

To achieve the foregoing object and in accordance with the invention, a manufacturing apparatus and method is provided for making pompons comprising means operable for splitting a strip of foil on each side of the longitudinal center thereof in such a manner that a continuous spine with sideways projecting needles is formed, winding a predetermined length of the strip on a coiling spindle, wrapping a binding wire around the coil, twisting the binding wire to bind the coil, and compression-shaping the coil between two compression members coaxially mounted on the coiling spindle in such a manner that after release of the compression members the needles spring back into a pompon of predetermined shape.

Where appropriate, the split-up strip of foil is seized on account of the spine being pressed between the ends of a divided coiling spindle extending parallel to the transverse dimension of the strip of foil for the purpose of coiling the predetermined length of strip. As regards the shape-pressing of the coiled article, a further development of the invention provides that the remaining shaping of the needles of the strip of foil increases outward for the coil's layers. In this manner a uniform needle distribution is obtained with an approximate spherical shape.

According to another aspect of the invention, clamping or pressing jaws are mounted in a feeding system so that together with the gripped strip they can be moved into a coiling position at which the coiling spindle halves can be inserted by their drive means into the opening of the clamping jaws. Advantageously, the two contacting ends of the coiling spindle halves respectively are made convex and concave for the purpose of mutual centering.

A set of tongs are utilized for applying the binding wire. Binding wire guides are provided in the tongs in an especially simple and advantageous manner by providing bores in the legs of the tongs, a guide tube being provided which is insertable into these bores. The guide tube may include a fixed tubular segment and an axially displaceable one which can move through the bores in the tong legs as far as the fixed tubular segment. The binding wire then slides freely through the two tubular segments and hence through the bores of the tongs.

To prevent the ends of the binding wire from being wound into the pompon when the tongs are rotated for binding, a further aspect of the invention provides for mounting gripper arms pivoting on the tong legs on both sides of the tongs along the extension of the bores, by means of which the binding wire is pulled out of the tubular segments prior to the rotation of the tongs.

According to still a further aspect of the invention, the pressing surfaces of the compression members are of a rotationally symmetrical design and of such a cross-section that the free space between the cross-sectional profiles is in the shape of an annular gap which, when seen in the radial direction, widens axially inwardly and outwardly. The space within the annular gap must be such that the coiling wire and the bound material can be accommodated. The outer widening of this free space ensures the proper distribution of the needles.

The support surface for the lower clamping and feeding jaw for the strip of foil appropriately is in the shape of a trough with an approximately V-shaped cross-section, and the opening for the coiling spindle halves passes through the bottom of the V-shaped groove, whereby essentially the spine of the fringed strip of foil is clamped between the coiling spindle halves. This ensures that the strip of foil is reliably gripped at the center and that a uniform pompon will be obtained.

Suitable materials for the strip of foil are especially plastics, for instance PVC, polyethylene or other substances available as foils. To improve appearance, the foils may be dyed, lacquered or metallized.

The accompanying drawings which are incorporated in and consitute a part of this specification, illustrate a preferred embodiment of the invention and, together with the description, serve to explain the principles of the invention.

DETAILED DESCRIPTION OF THE DRAWINGS

Figure 1:
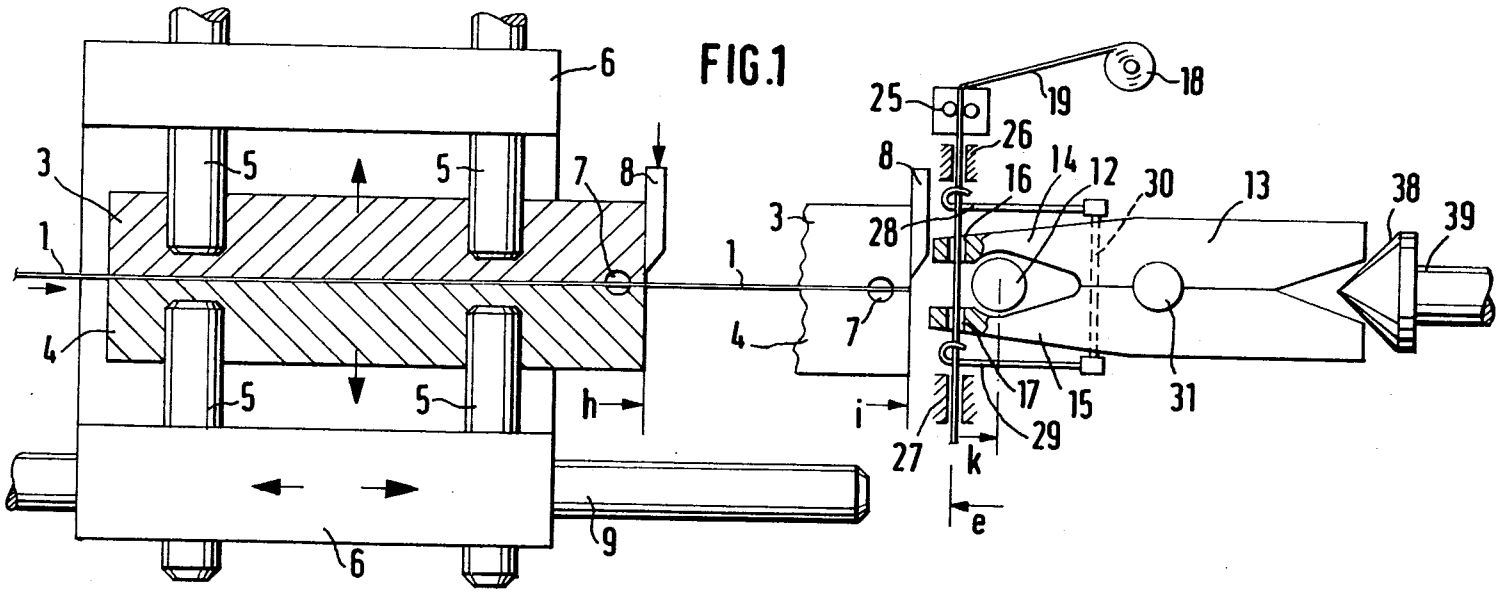
FIG. 1 is a schematic side view of a machine for making pompons according to the invention.

The raw material for making pompons is a strip of foil 1 (FIGS. 1 and 2) which is split up or fringed for instance by means of cutting rollers (not shown) on either side of its lengthwise center, needle-shaped structures being formed thereby, which extend from a middle, uncut spine 2 to the outside. The strip 1, which may be pretreated in a known manner, moves through two pressing or clamping jaws 3, 4, which can be pressed together, or pulled apart, by means of rods 5 supported in frame 6 and associated actuating cylinders (omitted).

Figure 2:
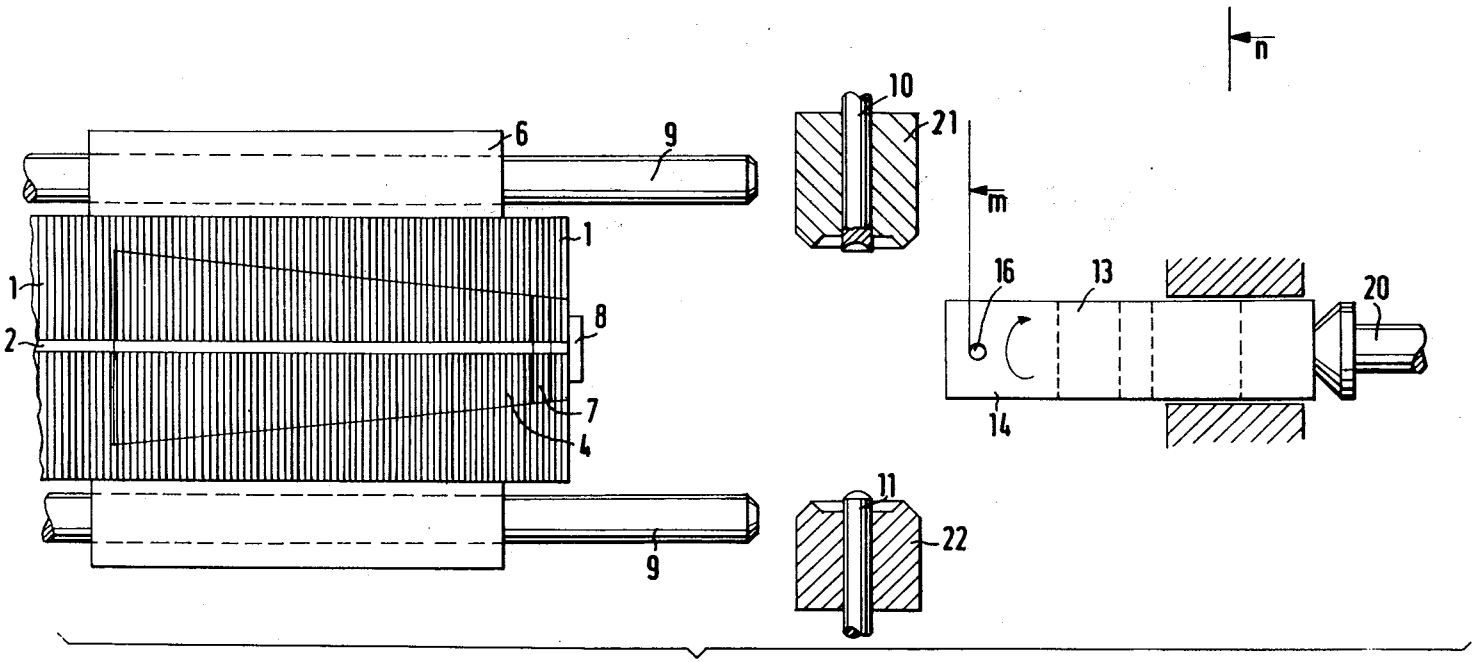
FIG. 2 is a schematic top view of the machine of FIG. 1.
Figure 4:
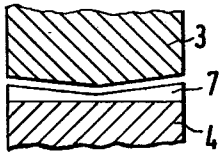
FIG. 4 is a schematic cross-section of a detail of the clamping jaws for the machine of FIGS. 1 and 2.

As shown in FIG. 2, wherein the upper clamping jaw 3 and its frame-part are omitted and the clamping jaw 4 is shown appearing through foil 1 for the sake of simplicity, the clamping jaws 3, 4 become smaller in the forward direction of motion of strip 1, whereby the needles of the strip project more. At the front end a bore 7 passes through the lower clamping jaw. The schematic cross-section of FIG. 4 shows the position of the bore 7 and the cross-sectional shape of the two clamping jaws 3, 4. The support surface of the lower clamping jaw 4 for the strip of foil 1 is shaped like a trough with a V-shaped cross-section, the slope being about 15° if so desired. Bore 7 passes through the clamping jaw 4 in such a manner that it intersects the trough at the bottom. The upper clamping jaw 3 is adapted in its cross-section to that of the lower clamping jaw 4. To cut off the strip of foil 1, a knife 8 ( shown schematically) is mounted on the upper clamping jaw 3.

The frame 6 with the clamping jaws 3, 4 can be horizontally displaced by means of a feed system (not shown) on slide rods 9 into three positions h, i, k, which are schematically denoted in FIG. 1 by the position of the front edge of the clamping jaws. In position k, two coiling spindle halves 10, 11 (FIG. 2) can be inserted by means of actuating cylinders (also not shown) into the bore 7 of the clamping jaws 3, 4. In this process they grip in accordance with the position of the bore 7 (FIG. 4), the spine 2 of the strip of foil 1, the needles of which they will not crush because of the V-shape of the support surface of the strip. Self-centering of the two coiling spindle halves 10, 11 is achieved by the provision of concave and convex shapes on their respective ends.

The manufacture of a pompon requires that a strip of foil be between the closed clamping jaws 3, 4 and be cut off at the front end by knife 8. Thereupon the feed system moves the frame 6 with the clamping jaws 3, 4 from the rest position h into the coiling position k. In this position, the two coiling spindle halves 10, 11 are inserted into bore 7 and by their front faces clamp the spine 2 of the strip of foil 1. Then the clamping jaws 3, 4 open upward and downward and are moved back into the rest position h by the feed system, the strip of foil 1 passing between the two open clamping jaws and being gripped by the coiling spindle halves 10, 11.

By means of a drive system (not shown), the coiling spindle halves 10, 11 are rotated to wind into a coil 12 of a predetermined length of foil, fixed by the number of revolutions, the foil being fed through the open clamping jaws 3, 4 from a supply spool during the coiling operation. After the coiling spindle drive is shut off, the open clamping jaws 3, 4 pass into the take-over position i (FIG. 1) and are closed with simultaneous clamping of the strip of foil. Knife 8 at the same time cuts off the foil 1 close to the spool 12 and the clamping jaws 3, 4 are returned to their rest position h.

Figure 5:
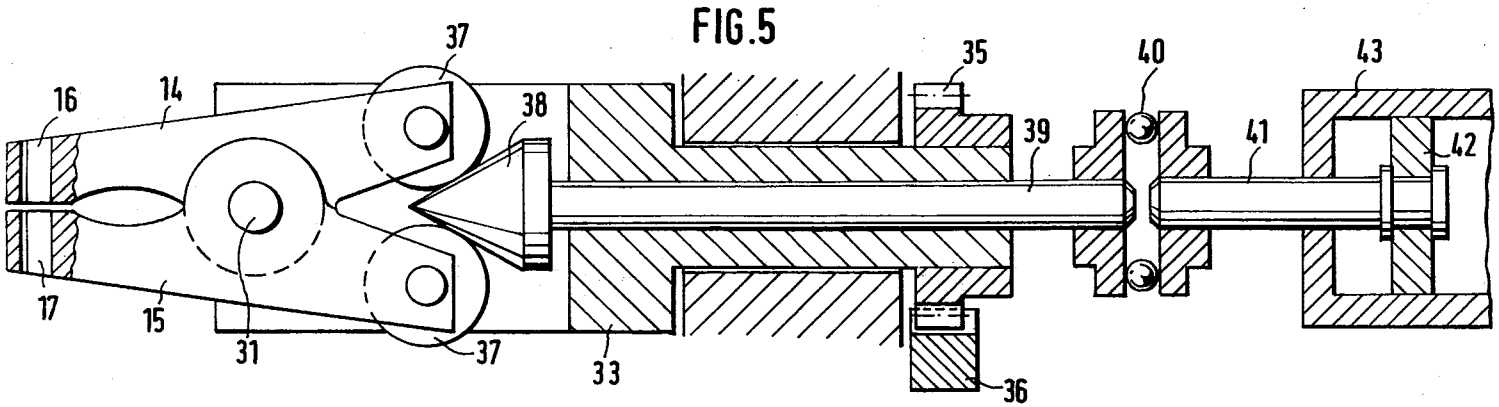
FIGS. 5 and 6 constitute a fairly precise representation of horizontally displaceable and rotatable tongs for the machine of FIGS. 1 and 2.
Figure 6:
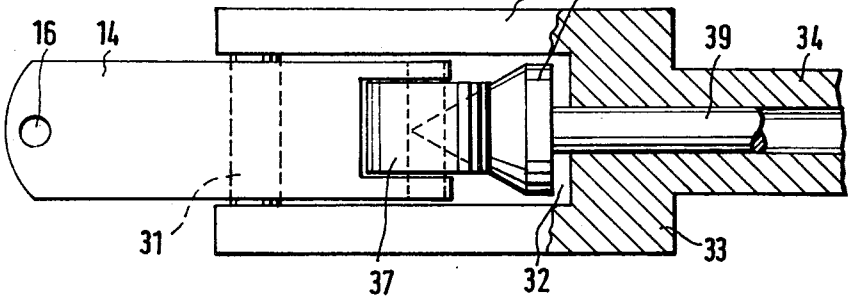

Horizontally movable tongs 13, which shall be described in greater detail below in relation to FIGS. 5 and 6, are brought into a position e as shown in FIG. 1 with their legs 14, 15 open and surrounding the coiled strip 12, said position being determined by the center axis of two mutually flush bores 16, 17 in legs 14, 15. A binding wire 19 from a supply spool 18 is pushed through the bores by means of a feed system 25 indicated schematically in FIG. 1. The feed system 25 feeds a piece of wire of a predetermined length and also ensures that it will be cut off. Guides 26, 27 ensure that the binding wire 19 is inserted into the bores 16, 17 and is kept in place reliably.

Tongs 13, which in addition to the motion of displacement, can also be rotated about their longitudinal axis, and so positioned that the two legs 14, 15 subtend the proper angle with bores 16, 17. Guides 26, 27 appropriately may be embodied by two tubular segments, one of which is fixed while the other is pushed by an actuating cylinder through the bores 16, 17 as far as the fixed one, where it centers itself. The binding wire 19 thereupon can be fed through the tubing so formed and it can thus slide without chance of catching or snagging. Thereafter, the movable tubular segment is returned to its rest position.

Tongs 13 are pulled back into position m (FIG. 2), the binding wire 19 surrounding the coil 12 at the center, i.e., approximately at the point of contact of the two coiling spindle halves 10, 11. The tongs' legs 14, 15 then will close, and the binding wire 19 is cut off. To prevent binding the ends of the binding wire when the tongs are subsequently rotated, gripper arms 28, 29 comprising eyelets pull the binding wire ends out of the two guides 26, 27, which in the present embodiment consist of two tubular segments. To that end the gripper arms 28, 29 rest on a common shaft 30 and carry out a pivotal motion. Thereafter the tongs 13 rotate about their longitudinal direction, for instance five to eight times, coil 12 being bound in this process. A projecting end of the binding wire 19, with an appropriately selected length, forms the suspension means or stem of the final pompon. Thereupon the tongs 13 return to the end position (FIG. 2).

Figure 3:
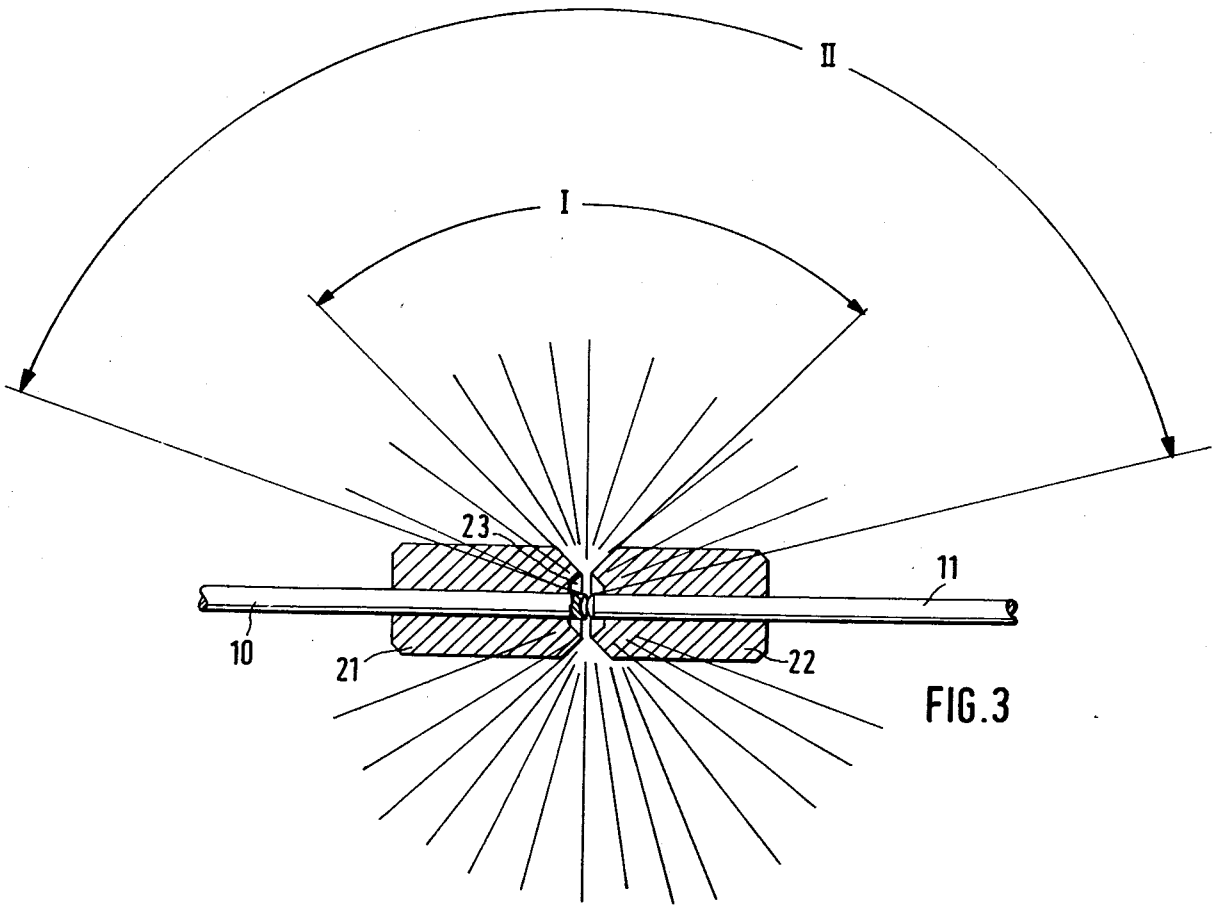
FIG. 3 illustrates schematically the press-shaping of the pompons using the machine of FIGS. 1 and 2.

As shown in FIG. 3, slidable compression members 21, 22 are mounted coaxially on the coiling spindle halves 10, 11. Like the coiling spindle halves 10, 11 they can be displaced by means of actuating cylinders, the piston rods of the cylinders for the compression members 21, 22 appropriately including bores for the passage of the coiling spindle halves 10, 11, or their piston rods.

The mutually facing, rotationally symmetrical surfaces of the two compression members 21, 22 have a concave profile. An annular gap 23 is thus created between the two compression members, where the needles of the strip of foil 1 are clamped tight. The cylindrical coil 12 therefore gives rise to a ring with the cross-section of a double cone indicated by the range I in FIG. 3. The remaining shaping of the needles of the individual coil layers varies, so that after the compression pieces 21, 22 are opened, the needles spring back in different manner and uniformly fill the space denoted by II in FIG. 3. On the whole therefore an approximately spherical pompon is thus obtained.

The process sequence described above with the individual operational steps of the machine can now be understood and practiced. The individual machine operational steps may be so adjusted in known manner by cyclical control that they take place at maximum speed and will mesh without mutual interference.

Tongs 13 are shown in further detail in FIGS. 5 and 6. The two tongs' legs 14, 15 are supported by means of an axial pin 31 in the slot 32 of a cylindrical tong body 33. Tong body 33 comprises a rear journal 34 by means of which it is supported in rotatable manner in the machine frame. Journal 34 has a gear 35 at its end which meshes with a rack 36. When the rack 36 has been displaced by a given distance by a compression cylinder (omitted), tongs 13 rotate in one sense or the other depending on the direction of displacement. The sequence in the manufacture of pompons is selected in such a manner that the pompons are alternatingly twisted in either direction, so that the tongs need not be rotated backward each time.

The opening of the tongs is effected by a spring (not shown), while the rollers 37 rotationally supported at the rear end of the tong legs 14, 15 roll off the outer surface of a cone 38 and displace the cone together with a shaft 39 fixed to it, a thrust bearing 40 and a piston rod 41 with the piston 42 of a compression cylinder 43 to the right (FIG. 5). When the tongs are to be closed, the piston 42 in cylinder 43 is subjected to pressure, so that the cone 38 compresses the rollers 37 and hence the legs 14, 15 of tongs 13.

It will be apparent to those skilled in the art that various modifications and variations could be made to the embodiment of the invention as hereinabove described without departing from the spirit and scope of the invention.

What is claimed is

1. A process for making pompons, comprising the steps of:

(a) splitting a strip of foil on each side of the longitudinal center thereof in such a manner that a continuous spine with sideways projecting needles is formed;

(b) winding a predetermined length of said split strip on a coiling spindle to form a coil;

(c) fastening the end of said wound strip to prevent said coil from unwinding; and (d) compression-shaping said coil between two compression members coaxially mounted to said coiling spindle in such a manner that after release by said compression members, the needles spring back into a pompon of predetermined shape.

2. The process of claim 1, characterized in that said winding step includes gripping the spine of said split strip of foil between the ends of a divided coiling spindle for the purpose of coiling the predetermined length of said strip, said spindle extending parallel to the transverse dimension of said strip of foil.

3. The process of either claims 1 or 2, characterized in that the compression-shaping of said coil takes place in such a manner that the remaining deformation of the needles of said strip of foil increases externally for the coil layers.

4. Apparatus for making pompons comprising:

(a) means for splitting a strip of foil on each side of the longitudinal center thereof to produce a continuous spine of foil with sideways projecting needles extending therefrom;

(b) means for winding a predetermined length of said continuous foil on a coiling spindle to form a coil;

(c) means for fastening the end of said wound strip to prevent said coil from unwinding; and (d) means for compression-shaping said coiled strip between a pair of compression members coaxially mounted on said coiling spindle in such a manner that after release of said compression members the needles on said coiled strip spring back into a pompon of predetermined shape.

5. The apparatus of claim 1, further comprising:

two clamping jaws through which said strip of foil passes for clamping, said jaws comprising an aperture transverse to the direction of motion for the coiling spindle halves;

a drive system for said coiling spindle allowing axial displacement of said coiling spindle halves into said aperture until the spine of said strip of foil is clamped and further allowing rotation of said spindle halves for coiling said clamped strip of foil; and tongs for embracing said coil and comprising in their legs wire guide means for said binding wire and designed to be retractable behind the coil and rotatable.

6. The apparatus of claim 5 characterized in that said clamping jaws are mounted in a feeding system in such a manner that they are displaceable together with said clamped strip into a coiling position at which said coiling spindle halves can be inserted in said aperture by means of their drive system.

7. The apparatus of claims 5 or 6 characterized by a cutting means for cutting off a predetermined length of said strip.

8. The apparatus of claim 5 characterized in that the two ends facing each other of the coiling spindle halves are respectively designed to be concave and convex for their mutual centering.

9. The apparatus of claim 5 characterized in that the wire guide means on said tongs includes bores in the legs of said tongs and in that a guide tube is provided which can be inserted into said bores.

10. The apparatus of claim 9 characterized in that said guide tube comprises a fixed tubular segment and an axially displaceable tubular segment which can be moved through said bores of said legs as far as said fixed tubular segment.

11. The apparatus of claim 10 characterized in that pivoting gripper arms are mounted on both sides of said tongs along the extension of said bores in said legs, by means of which arms said binding wire is pulled out of said tubular segments before said tongs are rotated.

12. The apparatus of claim 5 characterized in that said compression members are slidably mounted on said coiling spindle halves and are displaceable by means of actuating cylinders.

13. The apparatus of claim 5 characterized in that the compression surfaces of said compression membes are rotationally symmetrical and are shaped such that the free space between said surfaces is in the shape of an annular gap which when viewed in the radial direction expands inwardly and outwardly.

14. The apparatus of claim 5 characterized in that the support surface of said lower clamping jaw for the strip of foil is trough-shaped with an approximately V-shaped cross-section and in that said aperture for the coiling spindle halves passes through the bottom of said trough. Such that essentially only the spine portion of said split strip of foil is clamped between said coiling spindle halves.

15. The process of claim 1 wherein said step of fastening comprises the steps of:

(c1) wrapping a binding wire around said coil; and (c2) twisting said binding wire to bind said coil.

16. The apparatus of claim 4 wherein said means for fastening comprises:

(c1) means for wrapping a binding wire around said coiled strip; and (c2) means for twisting said binding wire to bind said coiled strip.

* * * * *